US005630596A

United States Patent [19]

Rudolph

[11] Patent Number: 5,630,596

[45] Date of Patent: May 20, 1997

[54] BRAKE DEVICE FOR IN-LINE SKATES

[76] Inventor: Robert K. Rudolph, 9043 Moody Ave., Morton Grove, Ill. 60053

[21] Appl. No.: 389,286

[22] Filed: Feb. 16, 1995

[51] Int. Cl.[6] ..... A63C 17/14

[52] U.S. Cl. ..... 280/11.2; 188/4 B; 188/17; 280/11.22

[58] Field of Search ..... 280/11.2, 11.22, 280/11.27, 11.28; 188/4 B, 17, 18 A, 25, 26

[56] References Cited

U.S. PATENT DOCUMENTS

| | | | |
|---|---|---|---|
| 1,445,048 | 2/1923 | Spross | 280/11.25 |
| 1,628,004 | 5/1927 | Stetson | 280/11.2 |
| 2,412,290 | 12/1946 | Rieske | 280/11.22 X |
| 3,000,643 | 8/1961 | Levin | 280/11.2 |
| 3,008,038 | 11/1961 | Dickens et al. | 362/103 |
| 3,385,608 | 5/1968 | Waddell | 280/11.2 |
| 3,823,952 | 7/1974 | Kukulowicz | 280/11.2 |
| 3,900,203 | 8/1975 | Kukulowicz | 280/11.2 |
| 3,945,655 | 3/1976 | Banks et al. | 280/11.2 |
| 4,027,890 | 6/1977 | Volkmann | 280/11.2 |
| 4,033,596 | 7/1977 | Andosen et al. | 280/11.2 |
| 4,055,234 | 10/1977 | Burton | 188/2 R |
| 4,061,348 | 12/1977 | Carter | 280/11.21 |
| 4,084,831 | 4/1978 | Akonteh | 280/11.2 |
| 4,275,895 | 6/1981 | Edwards | 280/11.2 |
| 4,418,929 | 12/1983 | Gray | 280/11.23 |
| 4,595,209 | 6/1986 | Tsai | 280/11.115 |
| 4,909,523 | 3/1990 | Olson | 280/11.2 |
| 4,911,456 | 3/1990 | Sarazen | 280/11.2 |
| 5,135,244 | 8/1992 | Allison | 280/11.2 |
| 5,143,387 | 9/1992 | Colla | 280/11.2 |
| 5,171,032 | 12/1992 | Dettmer | 280/11.2 |
| 5,197,575 | 3/1993 | Mangum et al. | 188/72.9 |
| 5,226,673 | 7/1993 | Cech | 280/11.2 |
| 5,232,231 | 8/1993 | Carlsmith | 280/11.2 |
| 5,239,941 | 8/1993 | Chibi | 280/11.2 |
| 5,351,974 | 10/1994 | Cech | 280/11.2 |
| 5,403,021 | 4/1995 | Shifrin | 280/11.2 |
| 5,411,276 | 5/1995 | Moldenhauer | 280/11.2 |
| 5,511,805 | 4/1996 | McGrath | 280/11.2 |

FOREIGN PATENT DOCUMENTS

| | | | |
|---|---|---|---|
| 2726961 | 1/1979 | Germany | 280/11.2 |
| 35107 | 4/1912 | Sweden . | |

*Primary Examiner*—Brian L. Johnson
*Assistant Examiner*—Michael Mar
*Attorney, Agent, or Firm*—Charles F. Meroni, Jr.

[57] ABSTRACT

An in-line roller skate braking device is provided. The in-line roller skate has a boot with a sole platform. A frame is mounted to a lower side of the sole platform. The frame has a pair of frame members in a space apart parallel relationship to one another. A plurality of wheels are supported for rotation in a common plane by a plurality of axles. The braking device includes a braking disc supported for rotation by a braking disc axle. A drive assembly is provided for interconnecting the braking disc with at least two of the wheels for synchronized wheel rotation. A braking assembly is provided for simultaneously moving a first brake pad against a first side of the braking disc and a second brake pad against a second side of the braking disc. Furthermore, an actuation assembly is provided for engaging said braking assembly.

21 Claims, 6 Drawing Sheets

BRAKE DEVICE FOR IN-LINE SKATES

BACKGROUND OF THE INVENTION

1. Field of the Invention

The present invention relates generally to in-line roller skates. More particularly, the invention pertains to an improved braking device for use with in-line skates for applying braking action to the wheels of the skates.

2. Description of the Prior Art

In-line roller skates have gained in popularity and use in recent years. These skates utilize a plurality of wheels arranged to rotate within a common plane and are capable of transporting a user at high rates of speed.

Various prior art braking devices to be used with in-line skates are known in the art. A typical example involves the use of a toe or heel stop. A piece of rubber is attached to the front or rear portion of the skate. Braking is achieved by a user tilting the skate in a forward or rearward direction to drag the piece of rubber on a skating surface. While these devices serve to provide a satisfactory braking means, they suffer from the disadvantage of being difficult to master, especially when skating on uneven surfaces.

To provide braking systems that are easy to use, many devices have been designed to allow a user to employ the braking system while keeping the wheels of the in-line skate firmly planted on the skating surface. For example, U.S. Pat. Nos. 5,171,032 and 5,351,974 issued to Dettmer and Cech, disclose in-line skate braking devices having brake pads which are positioned to come in contact with a number of selected wheels to cause braking action. However, these devices suffer from the disadvantage of requiring a separate hand held actuator to be connected to the skate by a cable to engage and disengage the braking action. The use of such an actuator can be both distracting and uncomfortable for users, especially when users wish to use their hands to maintain balance or hold additional objects.

U.S. Pat. No. 5,143,387 issued to Colla, discloses a braking assembly having brake pads which press against the wheels when the user's toes are curled and move a toe actuator located in the boot. While this device does provide a braking system that does not require the use of a separate hand held actuator, it suffers from a number of additional disadvantages. For example, the use of brake pads which engage against the outward portions of the wheels causes excessive wear of the wheels. Dirt and other particles that exist on the skating surface can also become lodged between the brake pad and wheel causing further damage to the wheels. An additional problem exists due to the location of the toe actuator within the boot. Besides the increased level of uncomfortableness involved with continued use, an additional risk of injury to the metatarsals or other bones of the foot does exist should the user crash or fall causing the boot to jam the toe actuator into the foot.

As will be described in greater detail hereinafter, the in-line skate braking device of the present invention differs from those previously proposed and employs a number of novel features that render it highly advantageous over the aforementioned prior art.

SUMMARY OF THE INVENTION

Accordingly, it is an object of this invention to provide an in-line roller skate with a braking device that allows the user to easy apply a sufficient braking force.

Another object of this invention is to provide a braking device that transmits braking energy to a plurality of interconnected wheels.

Still another object of this invention is to provide a braking device for an in-line skate having a leverage actuated system for applying the braking system.

Yet another object of this invention is to provide a braking device for an in-line skate having an actuation assembly utilizing a front portion of the sole of the skate boot which is adapted to both support the toes of a foot as well control the amount of required braking force.

To achieve the foregoing and other objectives, and in accordance with the purposes of the present invention a braking device for an in-line roller skate is provided. The in-line roller skate has a boot with a sole platform. A frame is mounted to a lower side of the sole platform. The frame has a pair of flame members in a space apart parallel relationship to one another. A plurality of wheels are supported for rotation in a common plane by a plurality of axles. The axles are operatively connected to the frame members. The braking device includes a braking disc supported for rotation by a braking disc axle. The braking disc axle is operatively connected to the frame members. A drive assembly is provided for interconnecting the braking disc with at least two of the wheels for synchronized wheel rotation. A braking assembly is provided for simultaneously moving a first brake pad against a first side of the braking disc and a second brake pad against a second side of the braking disc. Furthermore, an actuation assembly is provided for engaging said braking assembly.

In accordance with an aspect of the invention, one embodiment of the actuation assembly includes a pivot platform pivotally connected to the sole platform at a front portion of the boot. A biasing assembly is provided for moving the pivot platform from a toe engaged position in an angled relation from the sole platform to a toe unengaged position in a coplanar relation with the sole platform. A push rod is provided having a first end and a second end, the first end being operatively connected to the pivot platform and the second end being operatively connected to the braking assembly.

In accordance with another aspect of the invention, another embodiment of the actuation assembly is provided having a swivel member pivotally connected to an upper portion of the boot. An elongated leverage rod is provided having a first end, a second end, and a middle portion. The first end of the elongated leverage rod is connected to a back portion of the swivel member. A fulcrum bracket is connected to a back side of the boot. The middle portion of the elongated leverage rod is connected to the fulcrum bracket for movement of the elongated leverage rod. A second push rod is provided. The second push rod has a first end and a second end, the first end being pivotally connected to the second end of the elongated leverage rod and the second end of the second push rob being operatively connected to the braking assembly. A second biasing assembly provides movement of the second push rod in an outward direction from the in-line skate.

In accordance with yet another aspect of the invention, in a braking device for an in-line roller skate, the improvement comprises a braking assembly for applying braking energy to at least one of the wheels, a drive assembly coupled to the means for applying braking energy for interconnecting at least two of the wheels for synchronized wheel rotation so that braking energy applied to at least one of the wheels is transferred to a set of interconnected wheels; and an actuation assembly engaging said braking means.

Other objects, features and advantages of the invention will become more readily apparent upon reference to the following description when taken in conjunction with the accompanying drawings, which drawings illustrate several embodiments of the invention.

DETAILED DESCRIPTION OF THE PREFERRED EMBODIMENT

Figure 1:
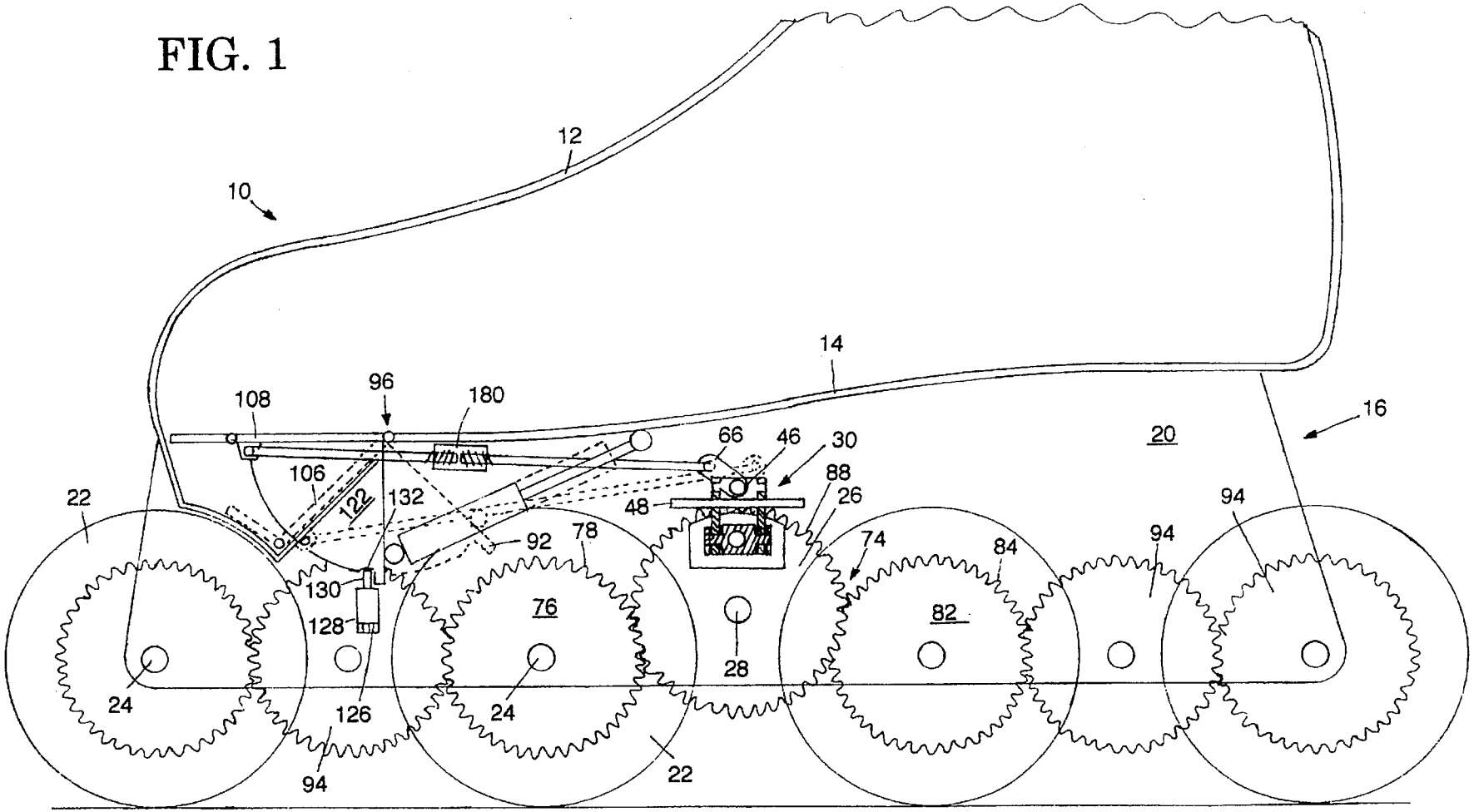
FIG. 1 is a side view of a first embodiment of the present invention.

Referring now to the drawings, an in-line roller skate 10 is illustrated in FIG. 1. The in-line roller skate 10 is of conventional design having a boot 12 with a sole platform 14. The boot 12 provides support for a foot and ankle of a user. A frame 16 is mounted to a lower side 18 of the sole platform. The frame 16 may be formed of aluminum or some other sturdy lightweight material. The frame 16 has a pair of frame members 20 in a space apart parallel relationship to one another. A plurality of wheels 22 are supported for rotation in a common plane by a plurality of axles 24. The wheels 22 are conventional in design having bearings incorporated within for smooth rotation and outer circumferential surfaces which are adapted to roll against a skating surface. The axles 24 are operatively connected to the frame members 24 to provide linearly arranged wheels 22. It should be understood that other boots, wheels, and frames can be substituted and equally applied to or integrated with the braking device of the present invention.

Referring to FIG. 1, a preferred embodiment of the braking device includes a braking disc 26 supported for rotation by a braking disc axle 28. The braking disc axle 28 is operatively connected to the frame members 24 by any conventional manner, preferably including bearings. A braking assembly 30 is provided for simultaneously moving a first brake pad 32 against a first side 34 of the braking disc 26 and a second brake pad 36 against a second side 38 of the braking disc 26.

Figure 6:
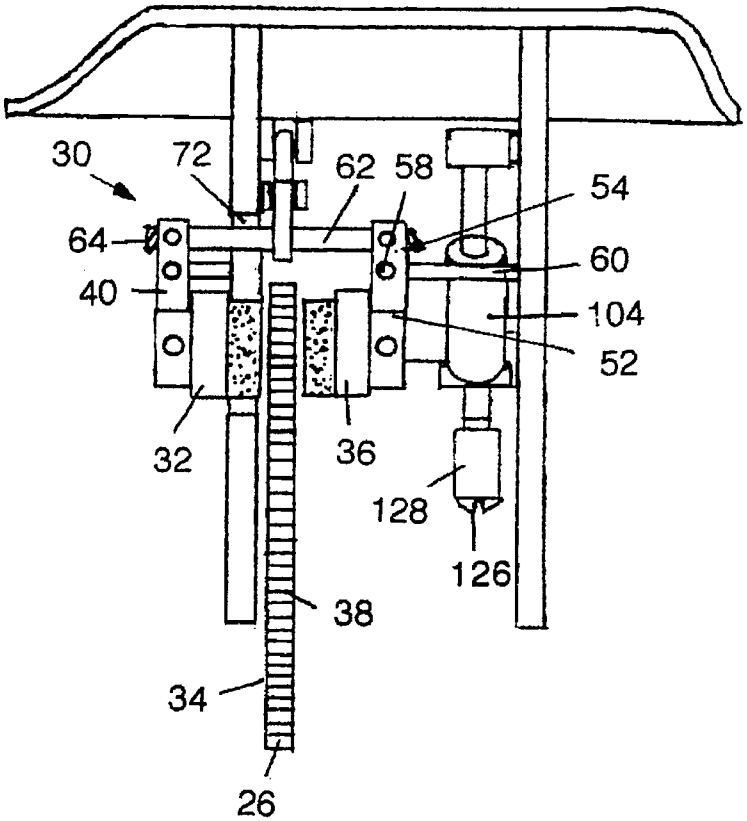
FIG. 6 is a partial sectional view taken through line 6—6 of FIG. 4.
Figure 5:
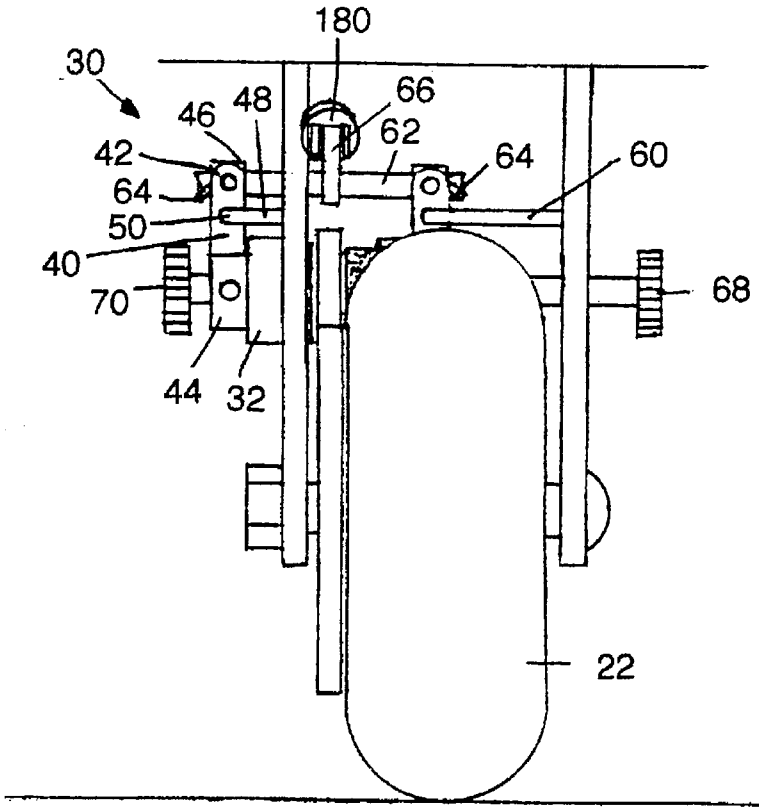
FIG. 5 is a partial sectional view taken through line 5—5 of FIG. 3.

As best illustrated in FIGS. 5 and 6, the braking assembly 30 is a caliper braking system having a first caliper arm 40 having a top end 42 and a bottom end 44. The bottom end 44 has the first brake pad 32 connected thereto. The top end has an aperture 46 therethrough. The first caliper arm 40 is pivotally attached to the frame adjacent to the first side 34 of the braking disc 26 with a first pivot bracket 48 which is inserted through apertures 50 in the first caliper arm 40 and is mounted perpendicularly to one of the frame members 24. A frame aperture 72 is provided in the frame member 24 to allow the first brake pad 32 to extend through. A second caliper arm 52 is provided having a top end 54 and a bottom end 56. The bottom end 56 has the second brake pad 36 connected thereto. The top end 54 has apertures 58 extending therethrough. The second caliper arm 52 is pivotally attached to the frame adjacent to the second side 38 of the braking disc 26 with a second pivot bracket 60 which is inserted through apertures 58 in the second caliper arm 52 and is mounted perpendicularly to the other frame member 24.

A caliper lever 62 having outwardly extending threaded ends 64 is provided. The threaded ends 64 operatively engaging the apertures of the top ends of the first caliper arm 40 and the second caliper arm 52. The threaded ends 64 are in opposite threaded relation to one another so that rotation of the caliper lever 62 in one direction will cause the bottom ends of the first caliper arm 40 and second caliper arm 52 to be pivotally drawn towards the braking disc 26 allowing the first brake pad 32 and second brake pad 36 to pressingly engage the braking disc 26. Rotation of the caliper lever 62 in an opposite direction will pull the first brake pad 32 and second brake pad 36 away from the braking disc. A lobe 66 is connected at a center portion of the caliper lever 62 for rotation of the caliper lever 62. It should be understood that caliper braking systems employed in other fields may be employed.

The first brake pad 32 and second brake pad 36 are formed of rubber or any other suitable friction type material. In use, the brake pads will wear requiring appropriate adjustment. To this end, a first adjustment screw 68 of conventional design is provided for manually adjusting the spaced apart distance between the first brake pad 32 and the first side of the braking disc 26. A second adjustment screw 70 of conventional design is provided for manually adjusting the spaced apart distance between the second brake pad 36 and the second side of the braking disc 26.

Figure 2:
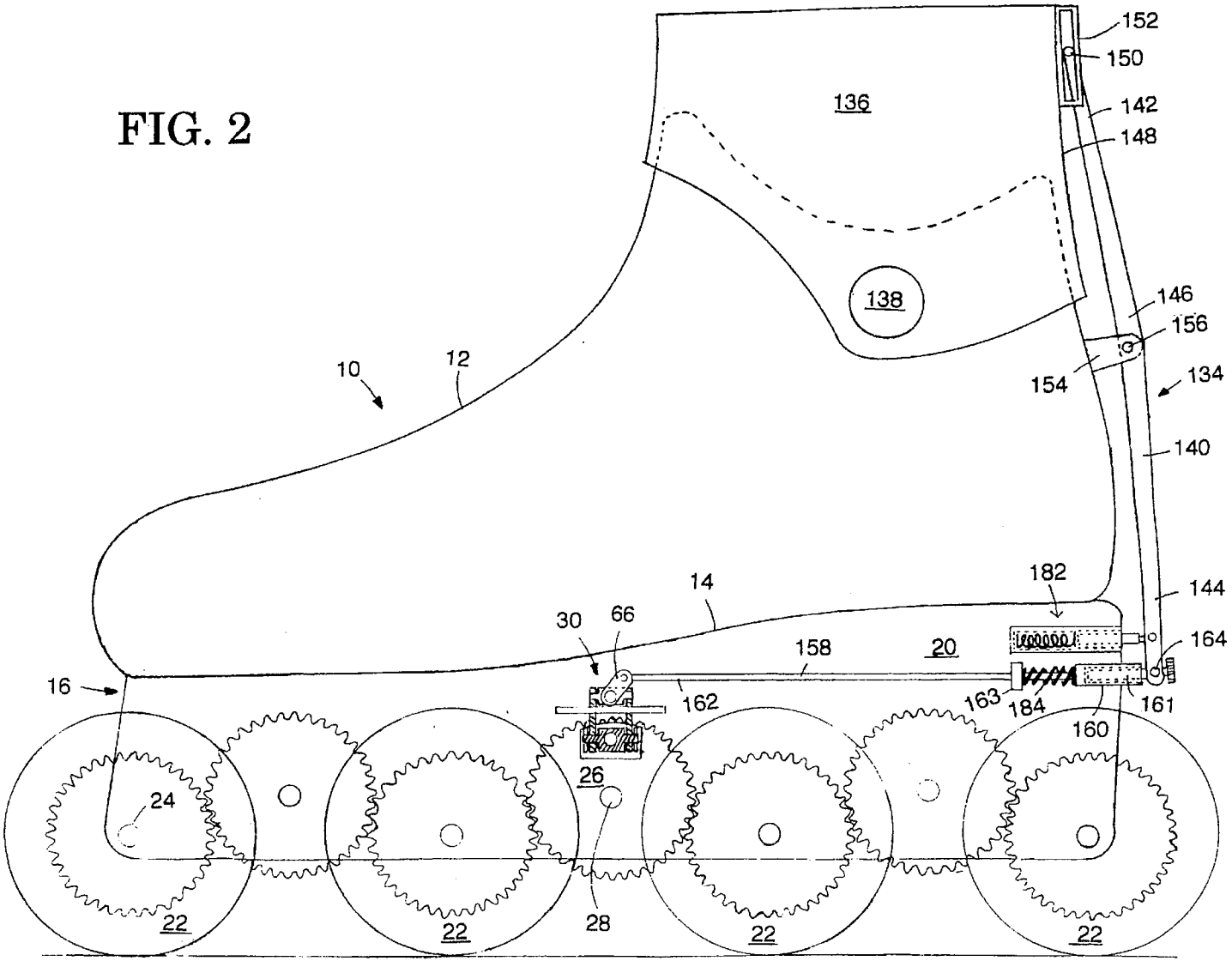
FIG. 2 is a side view of a second embodiment of the present invention.
Figure 3:
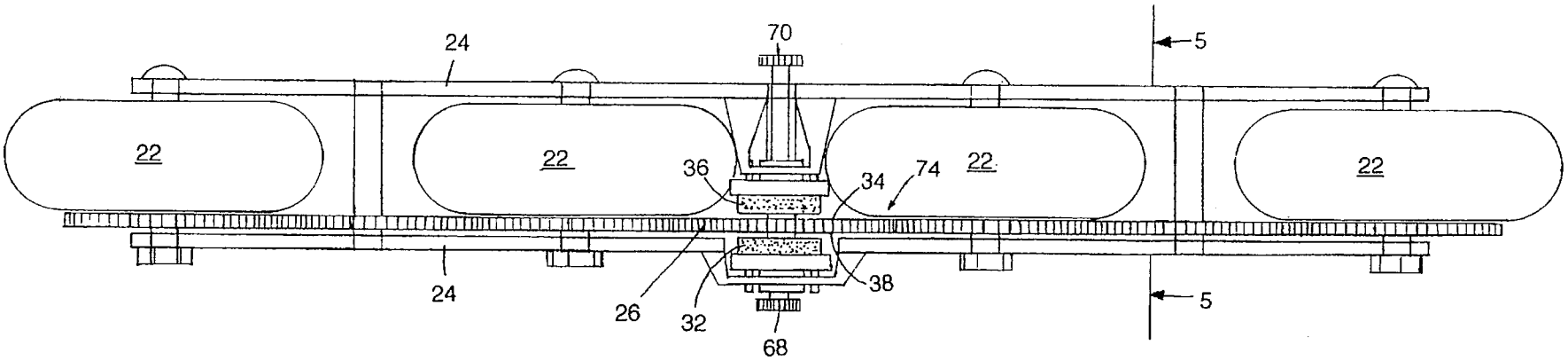
FIG. 3 is a partial bottom view of the present invention illustrating an embodiment of the drive assembly having interconnected wheels with a braking assembly mounted for actuation of a braking disc.

A drive assembly 74 is provided for interconnecting the braking disc 26 with at least two of the wheels 22 for synchronized wheel rotation. The drive assembly 74 preferably includes gears or discs which interconnect at least two of the wheels. As shown in FIGS. 1 and 2, a first gear 76 is mounted to one of the wheels 22 for rotation therewith. The first gear 76 has first gear teeth 78 around a circumferential edge 80 of the first gear 76. A second gear 82 is mounted to another one of the wheels 22 for rotation therewith. The second gear 82 has second gear teeth 84 around a circumferential edge 86 of the second gear 82. The brake disc 26 has third gear teeth 88 around a circumferential edge 90 of the brake disc 26. The third gear teeth 88 are in meshing engagement with the first gear teeth 78 and second gear teeth 84. Additional discs or gears 94 may be added in a similar fashion to interconnect additional wheels, as shown in the drawings.

It should be understood that while the gear assembly is preferred, other drive assemblies known in the art, such as pulley and cable drives, could also be employed to interconnect the wheels. It has been found that when braking energy is applied to at least one of the wheels or parts of the drive assembly and such braking force is thereby transferred to a set of interconnected wheels, superior braking results are achieved over those devices presently known in the art.

Figure 4:
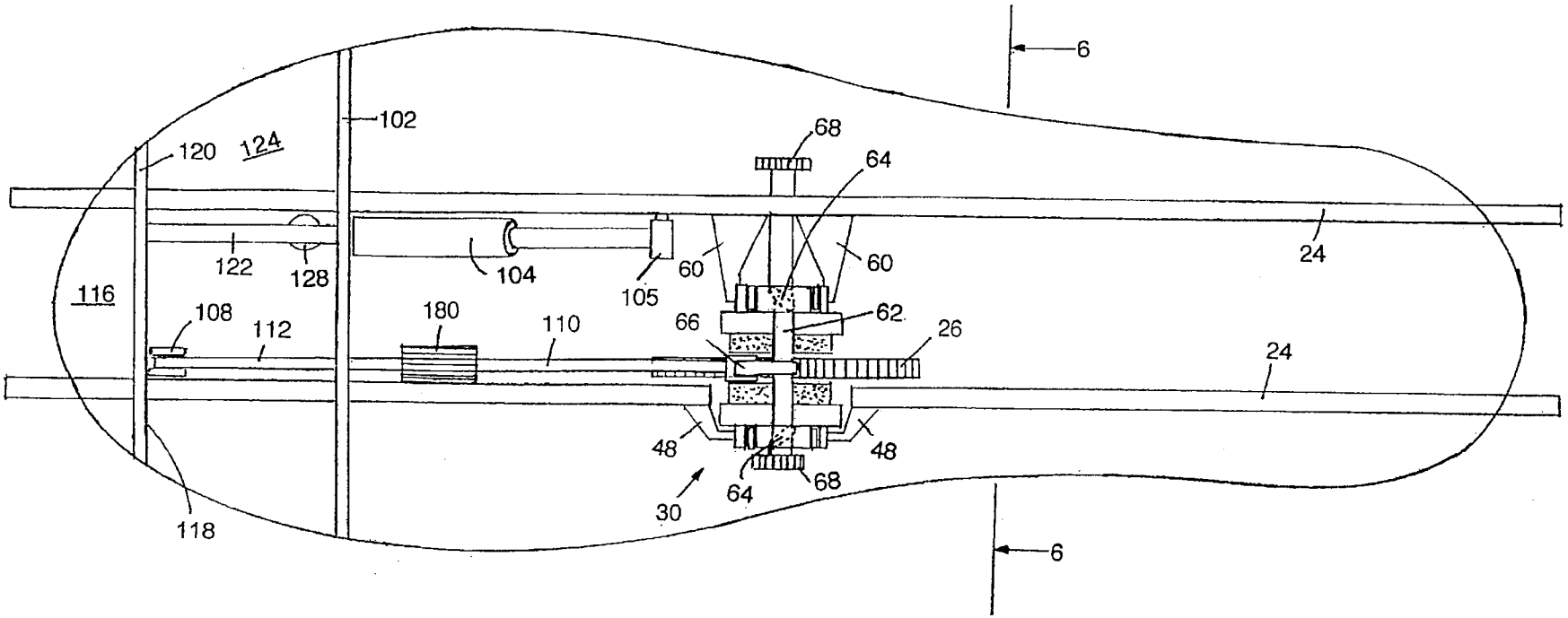
FIG. 4 is a partial top view of the present invention illustrating the braking assembly.

In order to actuate the braking assembly 30, an actuation assembly 96 integrated into the skate 10 is required. In a preferred actuation assembly 96 shown in FIGS. 1 and 4, a pivot platform 98 is pivotally connected to the sole platform 14 at a front portion 100 of the boot 12 with a first hinge 102. A biasing assembly 104, of any suitable type, such spring actuated, is provided for moving the pivot platform 98 from a toe engaged position 106 in an angled relation from the sole platform 14 to a toe unengaged position 108 in a coplanar relation with the sole platform 14.

A push rod 110 has a first end 112 and a second end 114. The first end 112 is pivotally connected to the pivot platform 98 and the second end being operatively connected to the lobe 66 braking assembly 30.

The pivot platform 98 includes a front flap 116 pivotally connected to a front edge 118 of the pivot platform 98 with a second hinge 120 for upward pivoting of the front flap 116 in relation to the pivot platform 98 when the pivot platform 98 is pressingly engaged into a toe engaged position 106.

Preferably, the biasing assembly 104 is pivotally connected to a cam member 122. The cam member 122 is connected perpendicular to a bottom side 124 of the pivot platform 98. A spring retainer assembly 126, of any suitable type, is mounted to the frame. Preferably, the spring retainer assembly includes a housing 128 having a spring engaged within which biases a pin 130 in an outward fashion. The spring retainer assembly may additionally contain an adjustment screw of conventional design to adjust the amount of force applied to the pin 130 by the spring. The pin 130 is pressingly engagable into a notch 132 of the cam member 122. The cam member 122 has a stop portion 92 to provide a horizontal stopping mechanism when engaging the pin 130.

In use, the adjustment of the spring retainer assembly 126 is used to adjust the amount of force required to release the actuation assembly 96. It is has been found that most of the weight of a user is distributed in the heel and ball of the foot. Therefore, only a small amount of force is constantly supplied by the toes of the foot to the pivot platform 98. When the toes of the foot are downwardly pressed into the pivot platform, the spring retainer assembly 126 releases the actuation assembly 96 so that the pivoting movement can actuate the braking assembly. As illustrated in the drawings, it is also significant to note that the braking disc 26, braking assembly 30, and drive assembly 74 are positioned remote from the outer circumferential surfaces of the wheels so that the outer circumferential surfaces remain free of encumbrance which would create excessive wear of the wheels, as was previously described with prior art braking systems.

In an alternative embodiment, an actuation assembly 134 is shown in FIG. 2. The actuation assembly 134 requires a swivel member 136 pivotally connected at pivot points 138 to an upper portion of the boot. An elongated leverage rod 140 has a first end 142, a second end 144, and a middle portion 146. The first end 142 of the elongated leverage rod 140 is connected to a back portion 148 of the swivel member 136. In a preferred embodiment shown in FIG. 2, a lateral pin 150 of the elongated leverage rod 140 slidingly engages within a slide bracket 152. A fulcrum bracket 154 is connected to a back side of the boot. The middle portion 146 of the elongated leverage rod 140 is pivotally connected to the fulcrum bracket with pivot pin 156 for movement of the elongated leverage rod 140.

A second push rod 158 has a first end 160 and a second end 162. The first end 160 includes a tubular housing 159 having a pin member 161 slidingly engaging within and is pivotally connected to the second end 144 of the elongated leverage rod 140 with pivot pin 164. The second end 162 of the second push rod 158 is connected to the lobe 66 of the braking assembly 30. A spring 184 biases the second push rod 158 in an outward direction against a bracket 163 which is connected to the frame member 24. In use, a forward tilt of the swivel member 136 will not cause movement of the second push rod 158 due to the outward movement of the pin member 161 within the housing 159. A backward tilt of the swivel member 136 will cause move of the second push rod 158 with the spring 184 biasing the rod 158 into a neutral position after the tilting ends.

A second biasing assembly 182 of conventional spring design is provided for moving the second push rod 158 in an outward direction from the in-line skate 10. In use, pivoting movement of a user's leg will pivot the swivel member 136 creating a leverage force with the elongated leverage rod 140 which moves the second push rod 158 to actuate the braking assembly 30.

Figure 7:
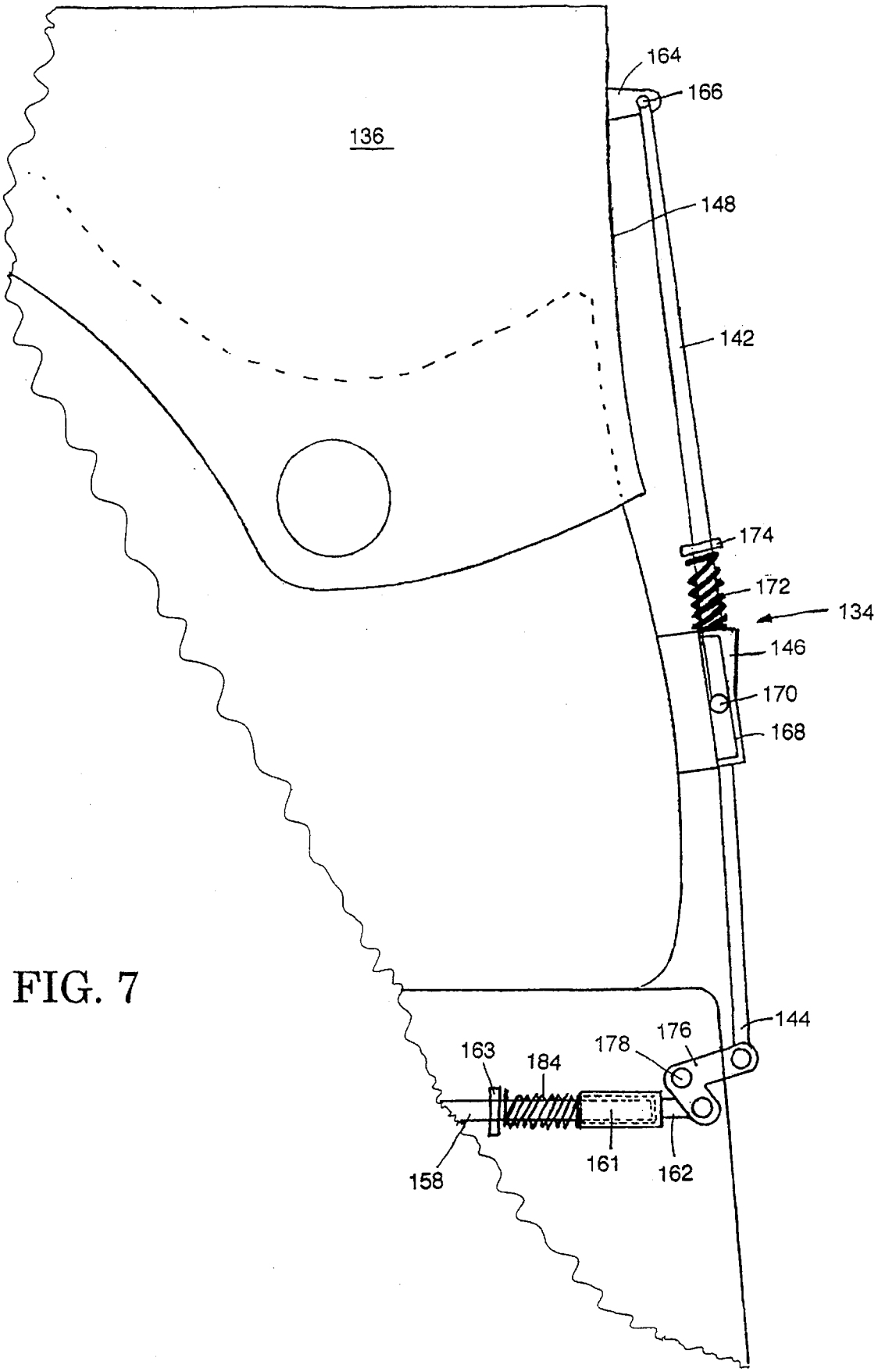
FIG. 7 is an alternative embodiment of an actuation assembly of the present invention.

An alternative embodiment of the actuation assembly 134 is shown in FIG. 7. The first end 142 of the elongated leverage rod 140 is pivotally connected to the back portion 148 of the swivel member 136 with a pivot bracket 164 and a pivot pin or member 166. A second slide bracket 168 is connected to the boot and slidingly engages a middle portion 146 of the elongated leverage rod 140 with a pivot pin 170. A spring 172 is located between the second slide bracket 168 and a ring member 174 for biasing of the elongated leverage rod 140. The second end 144 of the elongated leverage rod 140 is pivotally connected to a V-shaped transfer member 176 which pivots on screw 178. The transfer member 176 connects to the second end 162 of the second push rod 158 so that vertical movement of the elongated leverage rod 140 is transferred into horizontal movement of the second push rod 158. The second end 162 includes a tubular housing having a pin member slidingly engaging within. Additionally, a rod adjustment screw 180 of conventional design may be attached to the push rod 110 or second push rod 158 for manually adjusting the length of the rod.

It should be understood that the actuation assemblies described above have been found to be the preferred means to be coupled with the drive assembly. However, these actuation assemblies could equally be employed with braking assemblies of other design.

Although the invention has been described by reference to some embodiments it is not intended that the novel device be limited thereby, but that modifications thereof are intended to be included as falling within the broad scope and spirit of the foregoing disclosure, the following claims and the appended drawings.

I claim:

1. A braking device for an in-line roller skate having a boot with a sole platform, a frame mounted to a lower side of the sole platform, the frame having a pair of frame members in a spaced apart parallel relationship to one another, and a plurality of wheels supported for rotation in a common plane by a plurality of axles, the axles being operatively connected to the frame members, the braking device comprising:

(a) a braking disc supported for rotation by a braking disc axle, the braking disc axle being operatively connected to the frame members;

(b) drive means for interconnecting the braking disc with at least two of the wheels for synchronized wheel rotation;

(c) braking means for simultaneously moving a first brake pad against a first side of the braking disc and a second brake pad against a second side of the braking disc; and (d) actuation means for engaging said braking means, the actuation means including: a pivot platform pivotally connected to the sole platform at a front portion of the boot; biasing means for moving the pivot platform from a toe engaged position in an angled relation from the sole platform to a toe unengaged position in a coplanar relation with the sole platform; and a push rod having a first end and a second end, the first end being operatively connected to the pivot platform and the second end being operatively connected to the braking means.

2. The braking device of claim 1, wherein the pivot platform includes a front flap pivotally connected to a front edge of the pivot platform for upward pivoting of the front flap in relation to the pivot platform when the pivot platform is pressingly engaged into a toe engaged position.

3. The braking device of claim 1, wherein the biasing means is connected to a cam member, the cam member being connected perpendicular to a bottom side of the pivot platform.

4. The braking device of claim 3, further comprising a spring retainer assembly mounted to the frame, the spring retainer assembly having a pin pressingly engagable into a notch of the cam member.

5. A braking device for an in-line roller skate having a boot with a sole platform, a frame mounted to a lower side of the sole platform, the frame having a pair of frame members in a spaced apart parallel relationship to one another, and a plurality of wheels supported for rotation in a common plane by a plurality of axles, the axles being operatively connected to the frame members, the braking device comprising:

(a) a pivot platform pivotally connected to the sole platform at a front portion of the boot;

(b) biasing means for moving the pivot platform from a toe engaged position in an angled relation from the sole platform to a toe unengaged position in a coplanar relation with the sole platform;

(c) a push rod having a first end and a second end, the first end being operatively connected to the pivot platform and the second end being operatively connected to the braking means; and (d) means attached to the second end of the push rod for applying braking energy to at least two wheels of the in-line skate when the push rod is moved in a first direction and for disengaging braking energy to at least two wheels of the in-line skate when the push rod is moved in a second direction, said means including: a braking disc supported for rotation by a braking disc axle, the braking disc axle being operatively connected to the frame members; drive means for interconnecting the braking disc with at least two of the wheels for synchronized wheel rotation; and braking means for simultaneously moving a first brake pad against a first side of the braking disc and a second brake pad against a second side of the braking disc.

6. A braking device for an in-line roller skate having a boot with a sole platform, a frame mounted to a lower side of the sole platform, the frame having a pair of frame members in a spaced apart parallel relationship to one another, and a plurality of wheels supported for rotation in a common plane by a plurality of axles, the axles being operatively connected to the frame members, the braking device comprising:

(a) a pivot platform pivotally connected to the sole platform at a front portion of the boot, the pivot platform having a front flap pivotally connected to a front edge of the pivot platform for upward pivoting of the front flap in relation to the pivot platform when the pivot platform is pressingly engaged into a toe engaged position;

(b) biasing means for moving the pivot platform from a toe engaged position in an angled relation from the sole platform to a toe unengaged position in a coplanar relation with the sole platform;

(c) a push rod having a first end and a second end, the first end being operatively connected to the pivot platform and the second end being operatively connected to the braking means; and (d) means attached to the second end of the push rod for applying braking energy to at least two wheels of the in-line skate when the push rod is moved in a first direction and for disengaging braking energy to at least two wheels of the in-line skate when the push rod is moved in a second direction.

7. A braking device for an in-line roller skate having a boot with a sole platform, a frame mounted to a lower side of the sole platform, the frame having a pair of frame members in a spaced apart parallel relationship to one another, and a plurality of wheels supported for rotation in a common plane by a plurality of axles, the axles being operatively connected to the frame members, the braking device comprising:

(a) a pair of discs supported for rotation by disc axles, the disc axles being operatively connected to the frame members;

(b) drive means for interconnecting the pair of discs with at least three of the wheels for synchronized wheel rotation, one of said pair of discs being a braking disc, said pair of discs and drive means being positioned remote from outer circumferential surfaces of said at least three of the wheels so that the outer circumferential surfaces remain free of encumbrance from the braking device;

(c) braking means for moving a brake pad against a side of the braking disc; and (d) actuation means for engaging said braking means.

8. The braking device of claim 7, wherein the actuation means includes:

(a) a pivot platform pivotally connected to the sole platform at a front portion of the boot;

(b) biasing means for moving the pivot platform from a toe engaged position in an angled relation from the sole platform to a toe unengaged position in a coplanar relation with the sole platform; and (c) a push rod having a first end and a second end, the first end being operatively connected to the pivot platform and the second end being operatively connected to the braking means.

9. The braking device of claim 8, wherein the pivot platform includes a front flap pivotally connected to a front edge of the pivot platform for upward pivoting of the front flap in relation to the pivot platform when the pivot platform is pressingly engaged into a toe engaged position.

10. The braking device of claim 8, wherein the biasing means is connected to a cam member, the cam member being connected perpendicular to a bottom side of the pivot platform.

11. The braking device of claim 10, further comprising a spring retainer assembly mounted to the frame, the spring retainer assembly having a pin pressingly engagable into a notch of the cam member.

12. The braking device of claim 7, wherein the drive means includes:

(a) a first gear mounted to one of the wheels for rotation therewith, the first gear having first gear teeth around a circumferential edge of the first gear;

(b) a second gear mounted to another one of the wheels for rotation therewith, the second gear having second gear teeth around a circumferential edge of the second gear;

(c) the brake disc having third gear teeth around a circumferential edge of the brake disc, the third gear teeth being in meshing engagement with the first gear teeth and second gear teeth.

13. The braking device of claim 7, wherein the drive means includes gear means for interconnecting at least three of the wheels and the braking disc with gears having gear meshing teeth.

14. The braking device of claim 7, wherein the braking means includes:

(a) a first caliper arm having a top end and a bottom end, the bottom end having a first brake pad connected thereto, the top end having an aperture therethrough;

(b) means for pivotally attaching the first caliper arm to the frame adjacent to a first side of the braking disc;

(c) a second caliper arm having a top end and a bottom end, the bottom end having a second brake pad connected thereto, the top end having an aperture therethrough;

(d) means for pivotally attaching the second caliper arm to the frame adjacent to a second side of the braking disc;

(e) a caliper lever having outwardly extending threaded ends, the threaded ends operatively engaging the apertures of the top ends of the first caliper arm and the second caliper arm, the caliper lever having a lobe for connection to the actuation means.

15. The braking device of claim 14, further comprising:

(a) first adjustment means for manually adjusting the spaced apart distance between the first brake pad and the first side of the braking disc; and (b) second adjustment means for manually adjusting the spaced apart distance between the second brake pad and the second side of the braking disc.

16. A braking device for an in-line roller skate having a boot with a sole platform, a frame mounted to a lower side of the sole platform, the frame having a pair of frame members in a spaced apart parallel relationship to one another, and a plurality of wheels supported for rotation in a common plane by a plurality of axles, the axles being operatively connected to the frame members, the braking device comprising:

(a) a pivot platform pivotally connected to the sole platform at a front portion of the boot;

(b) biasing means for moving the pivot platform from a toe engaged position in an angled relation from the sole platform to a toe unengaged position in a coplanar relation with the sole platform;

(c) a push rod having a first end and a second end, the first end being operatively connected to the pivot platform; and (d) braking means attached to the second end of the push rod for applying braking energy to at least two wheels of the in-line skate when the push rod is moved in a first direction and for disengaging braking energy to at least two wheels of the in-line skate when the push rod is moved in a second direction, said braking means including a braking disc supported for rotation by a braking disc axle, the braking disc axle being operatively connected to the frame members, said braking means including drive means for interconnecting the braking disc with said at least two of the wheels for synchronized wheel rotation, said braking means and drive means being positioned remote from outer circumferential surfaces of said at least two of the wheels so that the outer circumferential surfaces remain free of encumbrance from the braking device.

17. The braking device of claim 16, wherein the means attached to the second end of the push rod includes means for simultaneously moving a first brake pad against a first side of the braking disc and a second brake pad against a second side of the braking disc.

18. The braking device of claim 16, wherein the pivot platform includes a front flap pivotally connected to a front edge of the pivot platform for upward pivoting of the front flap in relation to the pivot platform when the pivot platform is pressingly engaged into a toe engaged position.

19. The braking device of claim 16, wherein the biasing means is connected to a cam member, the cam member being connected perpendicular to a bottom side of the pivot platform.

20. The braking device of claim 19, further comprising a spring retainer assembly mounted to the frame, the spring retainer assembly having a pin pressingly engagable into a notch of the cam member.

21. A braking device for an in-line roller skate having a boot with a sole platform, a frame mounted to a lower side of the sole platform, the frame having a pair of frame members in a spaced apart parallel relationship to one another, and a plurality of wheels supported for rotation in a common plane by a plurality of axles, the axles being operatively connected to the frame members, the braking device comprising:

(a) a braking disc supported for rotation by a braking disc axle, the braking disc axle being operatively connected to the frame members;

(b) drive means for interconnecting the braking disc with at least two of the wheels for synchronized wheel rotation, the braking disc and drive means being positioned remote from outer circumferential surfaces of said at least two of the wheels so that the outer circumferential surfaces remain free of encumbrance from the braking device;

(c) braking means for moving a brake pad against a side of the braking disc; and (d) actuation means for engaging said braking means which includes means operatively connected to said braking means which are adapted to be actuated by a foot of the skater.

* * * * *